US009010428B2

(12) United States Patent
Mazyar et al.

(10) Patent No.: US 9,010,428 B2
(45) Date of Patent: Apr. 21, 2015

(54) SWELLING ACCELERATION USING INDUCTIVELY HEATED AND EMBEDDED PARTICLES IN A SUBTERRANEAN TOOL

(75) Inventors: Oleg A. Mazyar, Houston, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 536 days.

(21) Appl. No.: 13/225,957

(22) Filed: Sep. 6, 2011

(65) Prior Publication Data

US 2013/0056209 A1 Mar. 7, 2013

(51) Int. Cl.
*E21B 36/00* (2006.01)
*E21B 33/12* (2006.01)

(52) U.S. Cl.
CPC ..... *E21B 33/1208* (2013.01)

(58) Field of Classification Search
CPC ..... E21B 33/1208
USPC ..... 166/387, 373, 228, 192, 276, 302, 187, 166/195
See application file for complete search history.

(56) References Cited

U.S. PATENT DOCUMENTS 2,789,195 A * 4/1957 Hortvet ..... 219/644
3,716,101 A 2/1973 McGowen, Jr. et al.
4,017,414 A 4/1977 Black et al.
4,264,362 A 4/1981 Sergev et al.
4,515,213 A 5/1985 Rogen et al.
4,538,682 A 9/1985 McManus et al.
5,582,251 A 12/1996 Bailey et al.
6,278,095 B1 8/2001 Bass et al.
6,278,096 B1 8/2001 Bass
6,285,014 B1 9/2001 Beck et al.
6,384,389 B1 * 5/2002 Spencer ..... 219/635
6,926,083 B2 8/2005 Larovere
7,013,979 B2 3/2006 Richard
7,104,317 B2 9/2006 Richard et al.
7,152,657 B2 12/2006 Bosma et al.
7,318,481 B2 1/2008 Richard
7,441,596 B2 10/2008 Wood et al.
7,552,768 B2 6/2009 O'Brien (Continued)

FOREIGN PATENT DOCUMENTS

CA 1215642 12/1986
CN 2078793 6/1991

(Continued)

OTHER PUBLICATIONS

Aiyejina, A., et al.; "Wax Formation in Oil Pipelines: A Critical Review", Int. J. Multiphase Flow; 1-24, 2011.

(Continued)

*Primary Examiner* — Jennifer H Gay
*Assistant Examiner* — George Gray
(74) *Attorney, Agent, or Firm* — Steve Rosenblatt

(57) ABSTRACT

The swelling rate of a swelling packer element or a conforming foam screen material is accelerated with heat. Ferromagnetic particles or electrically conductive resins or polymers are interspersed in the swelling material and heat is generated at the particles by an inductive heater. A dielectric mandrel or base pipe can be used to focus the heating effect on the ferromagnetic particles or the electrically conductive resins or polymers in the sealing element or swelling foam screen element to focus the heating there without heating the base pipe. The heat accelerates the swelling process.

13 Claims, 3 Drawing Sheets

(56) References Cited

U.S. PATENT DOCUMENTS

| | | | | |
|---|---|---|---|---|
| 7,562,704 | B2 | 7/2009 | Wood et al. | |
| 7,597,152 | B2 | 10/2009 | Wood et al. | |
| 7,644,773 | B2 | 1/2010 | Richard | |
| 7,681,653 | B2 | 3/2010 | Korte et al. | |
| 7,703,539 | B2 | 4/2010 | Levy | |
| 7,730,940 | B2 | 6/2010 | Knippa et al. | |
| 7,997,338 | B2 | 8/2011 | Foster et al. | |
| 8,168,570 | B2 * | 5/2012 | Barron et al. | 507/269 |
| 8,187,252 | B2 * | 5/2012 | Buckley et al. | 604/508 |
| 8,763,687 | B2 * | 7/2014 | Ingram et al. | 166/187 |
| 2007/0137826 | A1 | 6/2007 | Bosma et al. | |
| 2008/0264647 | A1 | 10/2008 | Li | |
| 2009/0151957 | A1 | 6/2009 | Sickle et al. | |
| 2009/0159278 | A1 | 6/2009 | Corre et al. | |
| 2009/0223678 | A1 | 9/2009 | Richard et al. | |
| 2010/0181080 | A1 | 7/2010 | Levy | |
| 2011/0120733 | A1 * | 5/2011 | Vaidya et al. | 166/387 |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2012/0024109 | A1 | 2/2012 | Xu et al. | |
| 2012/0031611 | A1 | 2/2012 | Xu et al. | |
| 2012/0103135 | A1 | 5/2012 | Xu et al. | |
| 2012/0107590 | A1 | 5/2012 | Xu et al. | |
| 2013/0150533 | A1 * | 6/2013 | Budhlall et al. | 525/447 |

FOREIGN PATENT DOCUMENTS

| | | |
|---|---|---|
| RU | 2188932 | 9/2002 |
| RU | 2198284 | 2/2003 |
| RU | 2284407 | 9/2006 |
| WO | 2007055592 | 5/2007 |
| WO | 2011039544 | 4/2011 |

OTHER PUBLICATIONS

Scarmento, R.C.; "Wax Blockage Removal by Inductive Heating of Subsea Pipelines"; Heat Transfer Engineering, 25(7); 2-12, 2004.

* cited by examiner

SWELLING ACCELERATION USING INDUCTIVELY HEATED AND EMBEDDED PARTICLES IN A SUBTERRANEAN TOOL

FIELD OF THE INVENTION

The field of the invention is subterranean tools that deploy by swelling and more particularly construction details and techniques that accelerate the swelling rate for faster deployment.

BACKGROUND OF THE INVENTION

Packers made of an element that swells in oil or water have been in use for some time as evidenced by U.S. Pat. Nos. 7,997,338; 7,562,704; 7,441,596; 7,552,768; 7,681,653; 7,730,940 and 7,597,152. These designs focus on construction techniques for faster deployment, mechanical compression assists to the swelling or enhancing the performance of an inflatable using an internal swelling material to enhance the seal, elimination of leak paths along the mandrel after swelling and running conduits through the swelling sealing element and still having a good seal.

Shape conforming screens that take the shape of open hole and act as screens have been disclosed using shape memory foam that is taken above its transition temperature so that the shape reverts to an original shape which is bigger than the surrounding open hole. This allows the foam to take the borehole shape and act effectively as a subterranean screen. Some examples of this are U.S. Pat. Nos. 7,013,979; 7,318,481 and 7,644,773. The foam used heat from surrounding wellbore fluids to cross its transition temperature and revert to a shape that let it conform to the borehole shape.

One problem with swelling materials is that the swelling rate can be very slow and that effective deployment requires the swelling to complete to a particular degree before subsequent tasks can commence at the subterranean location. What is known is that if there is more heat that the swelling to the desired configuration, so that subsequent operations can commence, can happen sooner rather than later. Since time has an associated cost, it has been an object to accelerate the swelling or reverting to a former shape process, depending on the material involved.

Various techniques have added heat with heaters run in on wireline or embedded in the packer itself and triggered from a surface location, or have used the heat from well fluid at the deployment location, or heat from a reaction to chemicals pumped to the deployment location, or induction heating of shape memory metallic alloys. Some examples are: US Publication 2010/0181080; U.S. Pat. No. 7,703,539; US Publication 2008/0264647; US Publication 2009/0151957; U.S. Pat. Nos. 7,703,539; 7,152,657; US Publication 2009/0159278; U.S. Pat. Nos. 4,515,213; 3,716,101; US Publication 2007/0137826; CN2,078,793 U (steam injection to accelerate swelling); and US Publication 2009/0223678. Other references have isolated reactants and a catalyst in composite tubulars that have not been polymerized so they are soft so that they can be coiled for deployment and upon deployment expansion of the tubular allows the reaction to take place to make the tubular string rigid. This is illustrated in U.S. Pat. No. 7,104,317.

Bringing together discrete materials downhole for a reaction between them is illustrated in U.S. Pat. No. 5,582,251.

The present invention seeks to accelerate swelling in packers and screens made of swelling material by a variety of techniques. One way is to embed reactants and, if necessary, a catalyst in the swelling material and allow the reaction to take place at the desired location to speed the swelling to conclusion. This generally involves a removal of a barrier between or among the reactants in a variety of ways to get the exothermic reaction going. Various techniques of barrier removal are described. The heat is given off internally to the swelling member where it can have the most direct effect at a lower installed cost.

Another heat addition alternative involves addition of metallic, preferably ferromagnetic particles or electrically conductive resins or polymers in the swelling material. Induction heating is used to generate heat at the particles or resin or polymer to again apply the heat within the element while taking up no space that is of any consequence to affect the ability of the packer to seal when swelling or the screen to exclude particles when the screen is against the borehole wall in an open hole, for example. Optionally the mandrel can be dielectric such as a composite material so that the bulk of the heating is the particles alone. Otherwise the mandrel itself can also be heated and transfer heat to the surrounding element. Induction heating of pipe is known for transfer of heat to surrounding cement as discussed in U.S. Pat. No. 6,926,083 but the rate of heat transfer is very much dependent on a temperature gradient from the pipe into the cement and is less effective than inductively heating the object that needs the heat directly as proposed by the present invention. Also relevant is U.S. Pat. No. 6,285,014 which heats casing with an induction heater lowered into the casing with the idea that the heated casing will transfer heat to the surrounding viscous oil and reduce its viscosity so that it can flow.

Those skilled in the art will better appreciate additional aspects of the invention by a review of the detailed description of the preferred embodiments and the associated drawings while recognizing that the full scope of the invention is to be determined by the appended claims.

SUMMARY OF THE INVENTION

The swelling rate of a swelling packer element or a conforming foam screen material is accelerated with heat. In one variation reactants that create an exothermic reaction plus a catalyst, if needed, are allowed to come into contact upon placement at the desired location. In another technique metallic, preferably ferromagnetic, particles or electrically conductive resins or polymers are interspersed in the swelling material and heat is generated at the particles by an inductive heater. The particles can also be at least one of metallic nano- or microparticles, functionalized or not single-walled carbon nanotubes, multi-walled carbon nanotubes, graphene nanoribbons, fullerene, carbon nano-onions, functionalized or not nano- or microparticles of graphene and graphite. A dielectric mandrel or base pipe can be used to focus the heating effect on the ferromagnetic particles or the electrically conductive resins or polymers in the sealing element or swelling foam screen element to focus the heating there without heating the base pipe. The heat accelerates the swelling process and cuts the time to when the next operation can commence downhole.

DETAILED DESCRIPTION OF THE PREFERRED EMBODIMENT

Figure 1:
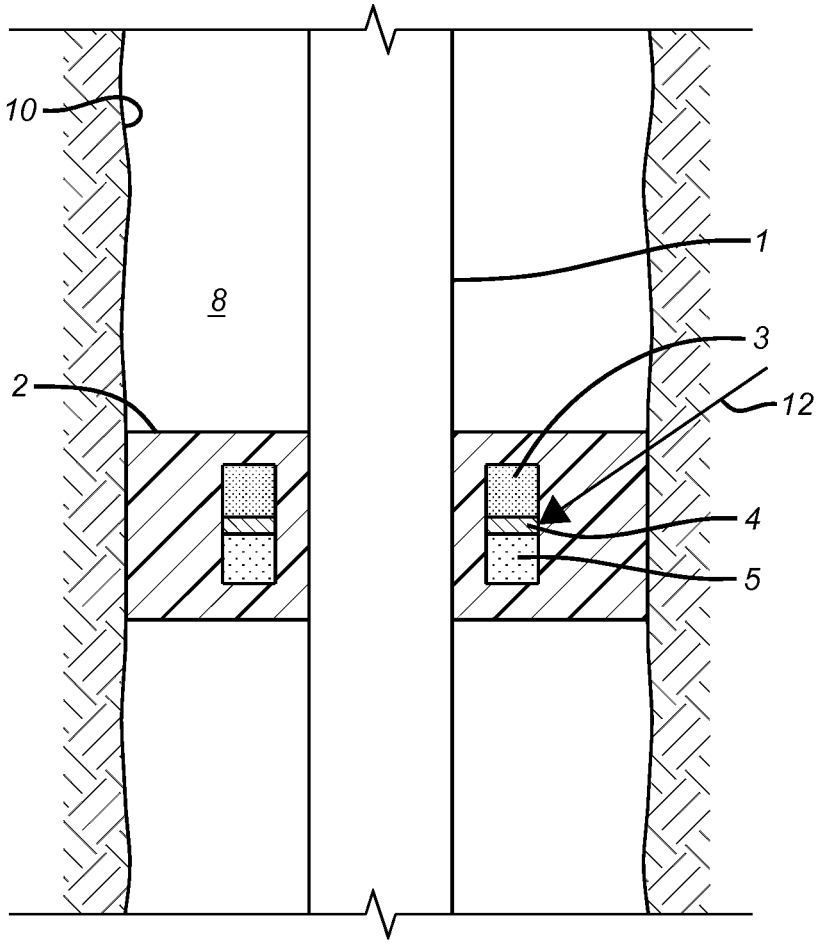
FIG. 1 is a schematic illustration of the embodiment where the reactants are held apart until they are allowed to mix and react to cause a release of heat to accelerate the swelling of the element.

Referring to FIG. 1, the mandrel 1 supports an element 2 that can be a swelling packer element or a porous screen material that swells. In either case the objective is to speed up the swelling process with the addition of heat so that the next operation at the subterranean location can take place without having to wait a long time for the swelling to have progressed to an acceptable level. FIG. 1 illustrates heat added directly into the element 2 as opposed to indirect ways that depend on thermal gradients for heat transfer such as using the temperature in the surrounding well fluids in the annulus 8 of the wellbore 10, which is preferably open hole but can also be cased or lined. Compartments 3 and 5 are separated by a barrier 4. The individual reactants and a catalyst, if needed, are stored in compartments 3 and 5. At the desired location or even on the way to the desired location the objective is to make the barrier fail or become porous or otherwise get out of the way of separating the reactants in the compartments 3 and 5 so that such reactants with a catalyst, if any, can come together for an exothermic reaction that will enhance the swelling rate of the element 2.

Arrow 12 schematically illustrates the variety of ways the barrier 4 can be compromised. One option is a depth actuation where one side of the barrier is sensitive to hydrostatic pressure in the annulus 8 and the other compartment is isolated from hydrostatic pressure in the annulus 8. Exposure to pressure in annulus 8 to say compartment 3 can be through a flexible membrane or bellows that keeps well fluid separate from a reactant in compartment 3. At a given depth the annulus pressure communicating through compartment 3 and into the barrier 4 puts a differential pressure on the barrier to cause it to fail allowing compartments 3 and 5 to communicate and the exothermic reaction to start. Another variation on this if the annulus pressure is too low is to pressurize the annulus 8 when it is desired to start the reaction and the rest takes place as explained above when relying on hydrostatic in the annulus 8.

Another way is to use a timer connected to a valve actuator that when opened allows well fluid to get to the barrier 4 and either melt, dissolve or otherwise fail the barrier 4. The power for the timer and the actuator can be a battery located in the element 2.

Another way is to rely on the expected temperature of well fluid to permeate the element 2 and cause the barrier 4 to melt or otherwise degrade from heat from the well fluids.

Figure 3:
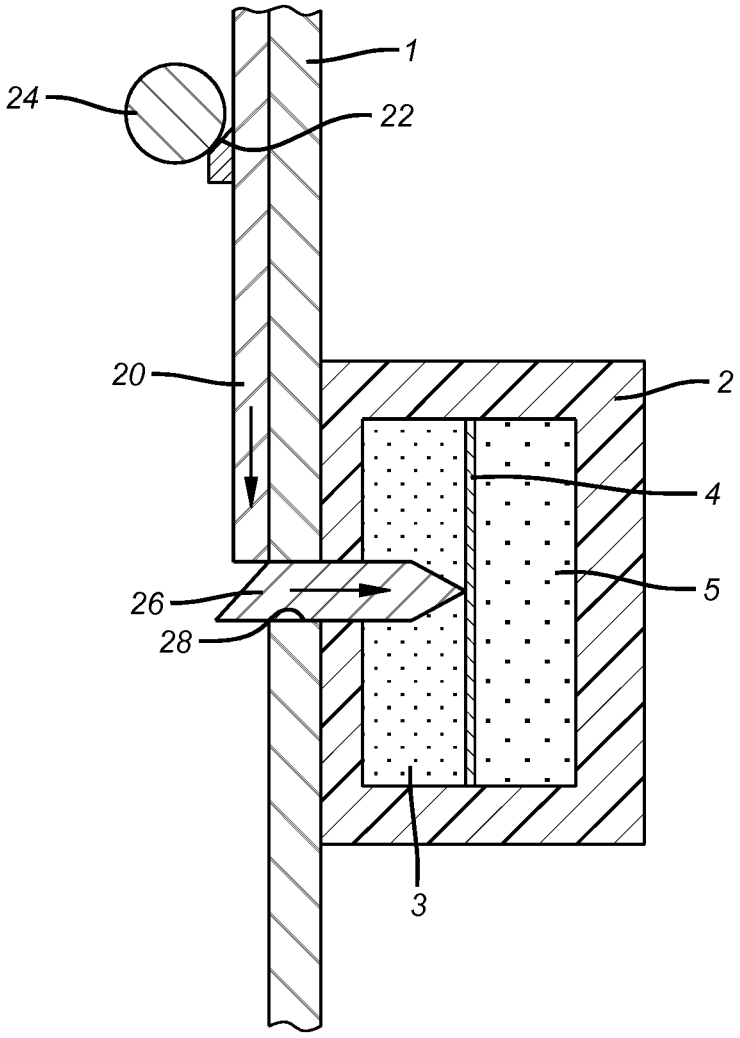
FIG. 3 shows the barrier between reactants broken with a shifting sleeve extending a knife.

FIG. 3 illustrates the compartments 3 and 5 separated by the barrier 4 located within the element 2 that is mounted to the mandrel or base pipe 1. A sleeve 20 has a ball seat 22 that accepts a ball 24. Pressure from above on the ball shifts the sleeve 20 and force knife 26 to move radially to penetrate the barrier 4. Note that the knife 26 moves through a wall opening 28. Alternatively the knife 26 can be induced to move axially to slice through the barrier 4 using a physical force as described above or equivalent physical force or by using an indirect force such as a magnetic field. If the operator finds the use of a wall opening 28 unacceptable in a swelling packer application then the knife can be magnetized and located within compartment 3 and a magnet can be delivered to the location of the element 2 so that the repulsion of the two magnets can advance the knife 26 axially or radially through the barrier 4. If the element 2 is a porous screen the tubular 1 will be perforated under the element 2 so that an opening 28 for the knife 26 should be of no consequence for the operator.

Another variation is to use galvanic corrosion using one or more electrodes associated with the barrier 4. In run in mode an electrode can be energized to prevent the onset of corrosion and ultimate failure of barrier 4, while in another mode the corrosion can be initiated using the same electrode or another electrode associated with the barrier 4. The process can be actuated from the surface or in other ways such as by time, pressure or temperature triggers to initiate the corrosion process. Alternatively, the barrier 4, itself can be the sacrificial member of a galvanic pair and just corrode over time. Alternatively a corrosive material can be stored in a pressurized chamber with a valve controlled by a processor to operate a valve actuator to allow the corrosive material to reach the barrier 4 and degrade the barrier to start the exothermic reaction.

Another alternative is to use at least one reactant that over time will attack the barrier 4 and undermine it. For example, one compartment contains dry powder or sintered powder of supercorroding magnesium alloy formed by a mechanical process that bonds magnesium and noble metal powder particles together in a strong electrical and mechanical bond as described in U.S. Pat. No. 4,264,362, or dry powder or sintered powder prepared by grounding the mixture of finely divided iron and magnesium powders as described in U.S. Pat. No. 4,017,414. The second compartment contains NaCl aqueous solution, seawater, etc. corrosive to the barrier 4 made of Mg alloy as described in the U.S. patent application Ser. No. 13/194,271, filed on Jul. 29, 2011. By adjusting the chemical composition of barrier 4 (see U.S. patent application Ser. No. 13/194,271, filed on Jul. 29, 2011), the thickness of the barrier and the salinity of the NaCl solution, the corrosion time of the barrier 4 can be determined and, thus, the time when the exothermic reaction between the chemicals in two compartments begins. This corrosion time depends on the temperature. Optionally, NaCl, KCl, etc. powders may be added to the first compartment to accelerate the exothermic reaction.

Thus for a swelling material that acts as a packer the compartments 3 and 5 and the barrier 4 between them can be embedded in the element 2. The same goes for the use of swelling foam that acts as a self-conforming screen with the difference being that the foam is deliberately porous and the mandrel or pipe 1 is perforated.

Figure 2:
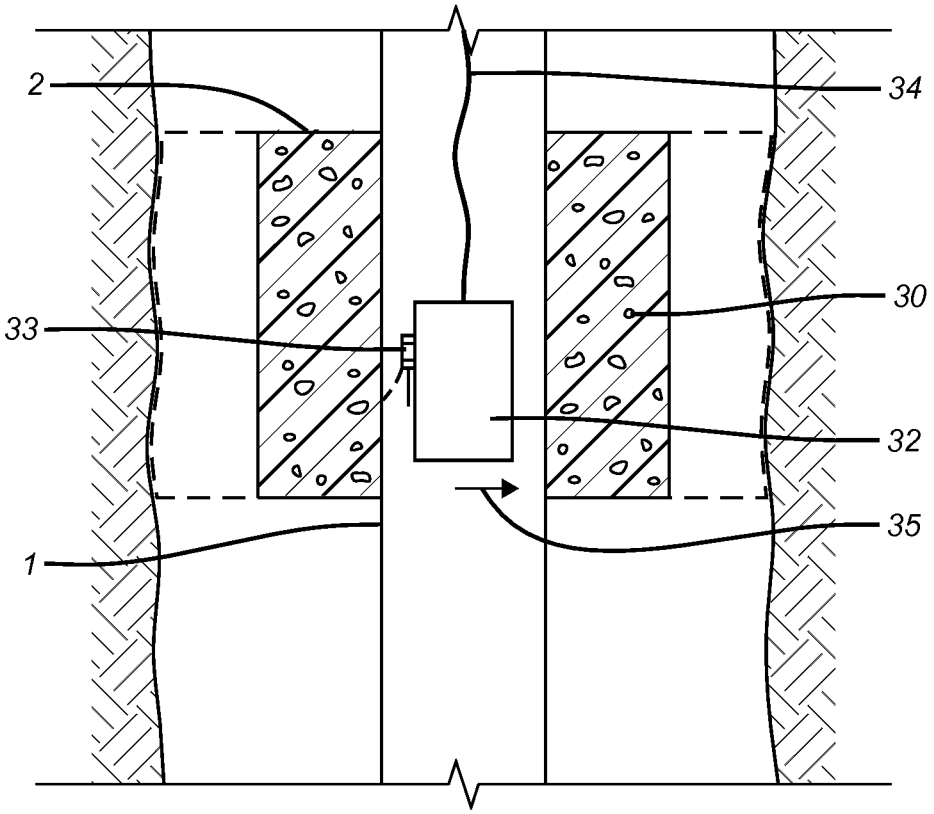
FIG. 2 is a schematic illustration of an alternative embodiment using ferromagnetic particles or the electrically conductive resins or polymers in the element and induction heating to accelerate swelling in the element.

Another alternative technique is schematically illustrated in FIG. 2. Here the swelling material 2 is impregnated or infused or otherwise produced to have a distribution of metal particles and preferably ferromagnetic particles 30. The particles can be positioned in swelling foam by forcing the particles through the material 2 during the fabrication process. This can be done with flow through the foam and can be coordinated with compressing the foam to get its profile reduced for run in. An induction heater 32 is preferably run in on wireline 34 for a power source although local power and a slickline can also be used. The heater 32 can be radially articulated once in position so that its coils extend into close proximity of the tubular inside wall. While electromagnetic induction heating can also be used to locally increase the temperature of a ferromagnetic pipe 1 on which a packer or a totally conformable screen 2 is mounted, the preferred method is to use a dielectric mandrel. If the pipe 1 is metallic, it will increase the temperature of the packer or the screen 2 mounted on it and, thus, will stimulate deployment. Induction heating is the process of heating an electrically conducting object (usually a metal) by electromagnetic induction, where eddy currents are generated within the metal and resistance leads to Joule heating of the metal. In an induction downhole heater 32, a coil of insulated copper wire is placed inside the production pipe 1 opposing the packer or the conformable screen 2. An alternating electric current from the power source on the ground level delivered for example through wireline 34, is made to flow through the coil, which produces an oscillating magnetic field which creates heat in the base pipe in two different ways. Principally, it induces an electric current in the base pipe, which produces resistive heating proportional to the square of the current and to the electrical resistance of the pipe. Secondly, it also creates magnetic hysteresis losses in the base pipe due to its ferromagnetic nature. The first effect dominates as hysteresis losses typically account for less than ten percent of the total heat generated. Induction heaters are faster and more energy-efficient than other electrical heating devices. Moreover, they allow for instant control of heating energy. Since the induction heaters are more efficient when in the close proximity to the base pipe, it is suggested that the copper wire coils are mounted on an expandable, toward the pipe wall, wire line tool activated when it reaches the level of the packer or the screen.

If the mandrel 1 is dielectric, then the full effect of the heater 32 will go into the ferromagnetic particles 30 that are embedded in the element 2 and locally heat the element 2 from within. Preferably the particles will be randomly distributed throughout the element 2 so that the swelling process can be accelerated. Alternatively the mandrel 1 can be electrically conductive and the heating effect will take place from the mandrel 1 and from the ferromagnetic particles 30, if the field is not completely shielded by the pipe 1.

The ferromagnetic particles 30 are most simply incorporated into the element 2 at the time the element 2 is manufactured. In the case of a foam element 2 the ferromagnetic particles 30 can be in a solution that is pumped through the foam under pressure so as to embed the particles in the foam from a circulating process. The particles can also be incorporated into the manufacturing process for the element 2 rather than being added thereafter. Another more complex alternative is to add the particles to the element 2 after the element is at the desired subterranean location but monitoring the effectiveness of this mode of ferromagnetic particle addition can be an issue.

As an alternative to the metal or ferromagnetic particles the element 2 can be impregnated with electrically conductive resins or polymers also shown schematically as 30 and with induction heater 32 the result is the same as the heating effect described above using ferromagnetic particles. The conductive particles could be metallic nano- or microparticles, functionalized or not single-walled carbon nanotubes, multi-walled carbon nanotubes, graphene nanoribbons, fullerene, carbon nano-onions, functionalized or not nano- or microparticles of graphene and graphite.

The heater 32 can be moved in a single trip to accelerate swelling at a series of packers or screen sections. In the case of packers pressure can be applied to see if there is leakage or not past the packer after a predetermined time of heat application.

The above description is illustrative of the preferred embodiment and many modifications may be made by those skilled in the art without departing from the invention whose scope is to be determined from the literal and equivalent scope of the claims below.

Another alternative technique is schematically illustrated in FIG. 2. Here the swelling material 2 is impregnated or infused or otherwise produced to have a distribution of metal particles and preferably ferromagnetic particles 30. The particles can be positioned in swelling foam by forcing the particles through the material 2 during the fabrication process. This can be done with flow through the foam and can be coordinated with compressing the foam to get its profile reduced for run in. An induction heater 32 is preferably run in on wireline 34 for a power source although local power and a slickline can also be used. The heater 32 can be radially articulated using device 33 once in position so that its coils extend into close proximity of the tubular inside wall. While electromagnetic induction heating can also be used to locally increase the temperature of a ferromagnetic pipe 1 on which a packer or a totally conformable screen 2 is mounted, the preferred method is to use a dielectric mandrel. If the pipe 1 is metallic, it will increase the temperature of the packer or the screen 2 mounted on it and, thus, will stimulate deployment. Induction heating is the process of heating an electrically conducting object (usually a metal) by electromagnetic induction, where eddy currents are generated within the metal and resistance leads to Joule heating of the metal. In an induction downhole heater 32, a coil of insulated copper wire is placed inside the production pipe 1 opposing the packer or the conformable screen 2. An alternating electric current from the power source on the ground level delivered for example through wireline 34, is made to flow through the coil, which produces an oscillating magnetic field which creates heat in the base pipe in two different ways. Principally, it induces an electric current in the base pipe, which produces resistive heating proportional to the square of the current and to the electrical resistance of the pipe. Secondly, it also creates magnetic hysteresis losses in the base pipe due to its ferromagnetic nature. The first effect dominates as hysteresis losses typically account for less than ten percent of the total heat generated. Induction heaters are faster and more energy-efficient than other electrical heating devices. Moreover, they allow for instant control of heating energy. Since the induction heaters are more efficient when in the close proximity to the base pipe, it is suggested that the copper wire coils are mounted on an expandable, toward the pipe wall, wire line tool activated when it reaches the level of the packer or the screen.

We claim:

1. A method of acceleration of swelling of at least one element made of a swelling material and having particles of a different material at a subterranean location, comprising:

forming said swelling material with randomly spaced embedded particles;

locating said at least one element on a mandrel and placing said mandrel adjacent at least one said subterranean location using a tubular string; and generating heat within said at least one element at the subterranean location by energizing said particles in said at least one element with an axially movable source for a field within the mandrel that is selectively positioned adjacent said at least one element after said at least one element is located at a subterranean location to accelerate element swelling by said particles at the subterranean location;

articulating said source for a field to move radially closer to said tubular string when said source for a field is adjacent said element.

2. The method of claim 1, comprising:

making said source for a field electromagnetic.

3. The method of claim 1, comprising:

making said particles metallic.

4. The method of claim 3, comprising:

making said particles magnetic.

5. The method of claim 4, comprising:

making said particles ferromagnetic.

6. The method of claim 1, comprising:

making said particles electrically conductive.

7. The method of claim 6, comprising:

making said particles electrically conductive resin or polymer.

8. The method of claim 1, comprising:

locating said particles in said element before locating said element with said tubular string.

9. The method of claim 1, comprising:

delivering said source for a field on wireline.

10. The method of claim 1, comprising:

providing said element as impervious for packer service or porous for screen service.

11. The method of claim 1, comprising:

forming at least a portion of said tubular string portion that is covered by said element of a dielectric material.

12. The method of claim 1, comprising:

using a plurality of elements on said tubular string;

moving said inductive heater to adjacent said elements in a single trip.

13. The method of claim 1, comprising:

making said particles at least one selected from a group of metallic nano- or microparticles, functionalized or not single-walled carbon nanotubes, multi-walled carbon nanotubes, graphene nanoribbons, fullerene, carbon nano-onions, or functionalized or not nano- or micro-particles of graphene and graphite.

* * * * *